US005439407A

United States Patent [19]

Friedel

[11] Patent Number: 5,439,407

[45] Date of Patent: Aug. 8, 1995

[54] DOLL WITH AN IMAGING HEART

[76] Inventor: Joan Friedel, 219 Northway, Baltimore, Md. 21218

[21] Appl. No.: 269,215

[22] Filed: Jun. 30, 1994

Related U.S. Application Data

[63] Continuation-in-part of Ser. No. 189,648, Feb. 1, 1994.

[51] Int. Cl.[6] ..... A63H 33/22

[52] U.S. Cl. ..... 446/219; 446/295; 446/485; 362/806; 362/811; 40/431; 434/236

[58] Field of Search ..... 446/219, 268, 295, 901, 446/485; 362/806, 808, 811; 40/431, 441, 442, 443; 434/236, 262

[56] References Cited

U.S. PATENT DOCUMENTS

| | | | |
|---|---|---|---|
| 1,528,506 | 3/1925 | Opacki | 40/431 |
| 2,001,116 | 5/1935 | Smith | 40/431 |
| 2,094,659 | 10/1937 | Levin | 40/431 |
| 2,204,435 | 6/1940 | Musaphia | 40/431 |
| 2,288,798 | 7/1942 | Fleming . | |
| 2,293,490 | 8/1942 | Lewis | 40/431 |
| 2,791,998 | 5/1957 | Decker | 40/431 |
| 2,831,963 | 4/1958 | Kurianski . | |
| 3,831,302 | 8/1974 | Gentilini | 40/431 |
| 3,885,797 | 5/1975 | Booty | 40/431 |
| 4,075,782 | 2/1978 | Neuschatz | 446/295 |
| 4,400,162 | 8/1983 | Rustemis | 40/431 |
| 4,585,424 | 4/1986 | DeMars | 446/295 |
| 4,601,668 | 7/1986 | Sirota . | |
| 4,989,120 | 1/1991 | Davis | 362/806 |
| 5,094,621 | 3/1992 | Friedel . | |
| 5,114,376 | 5/1992 | Copley et al. | 446/485 |
| 5,117,344 | 5/1992 | Perez . | |
| 5,197,885 | 3/1993 | Friedel . | |
| 5,328,401 | 7/1994 | DeMars | 446/485 |

*Primary Examiner*—Robert A. Hafer
*Assistant Examiner*—Jeffrey D. Carlson
*Attorney, Agent, or Firm*—Diller, Ramik & Wight

[57] ABSTRACT

A doll of this invention includes a torso having an upper chest portion, a pair of arms, a pair of legs and a head, the chest includes a predetermined area of a predetermined shape, such as a heart which is constructed from translucent colored plastic material. A light is located within the cavity behind the heart to create a varying silhouette which corresponds in configuration to the doll upon the illumination of the light within the doll. The varying configuration of the silhouette is created by rotating an object between a lamp and the translucent colored plastic material, and this imparts a varying size and shape to the silhouette. In its broader aspects, the present invention is not limited to a doll, but instead to the concept of a rotating object(s) positioned between a translucent imaging surface and a source of illumination can be utilized in a variety of other environments and objects. For example, a "bunny" or a "rabbit" can be rotated within a hollow plastic "egg" having a transparent wall and an internal lamp which will silhouette the rabbit upon the translucent wall. Another example would be a jewelry box having a plastic hollow heart housing a rotatable "ballerina" which when backlit casts a "dancing" ballerina silhouette upon a translucent wall of the housing.

33 Claims, 6 Drawing Sheets

DOLL WITH AN IMAGING HEART

CROSS-REFERENCE TO RELATED APPLICATION

This application is a continuation-in-part of application Ser. No. 08/189,648 filed on Feb. 1, 1994 and entitled A DOLL having a translucent area upon which a silhouette is formed.

BACKGROUND OF THE INVENTION

This invention is directed to a doll and constitutes an improvement of the doll disclosed in U.S. Pat. Nos. 5,094,621 and 5,197,885, granted respectively on Mar. 10, 1992 and Mar. 30, 1993 to Joan Friedel.

The doll disclosed in the latter patents was developed to enable and encourage a user thereof to get in touch with that which is referred to in psychiatric literature as the "inner child." The doll included a hollow interior and a movable shelf upon which appropriate items could be placed and when the door to the inner chamber is closed, the shelf automatically dropped causing any of the items thereupon to similarly "disappear." The shelf could include a small "inner child" seated thereon or the "inner child" might be painted in the cavity, and in either case such an "inner child" represents the childhood past of the utilizer of the doll. Thus, the adult or child utilizing the doll could talk to his "inner child" and find comfort therefrom.

Though the doll of these patents is effective for the intended purposes thereof, the doll is too complex in operation and some of the objects ("icons") are sufficiently small to present questions of physical harm/damage if, for example, ingested. Accordingly, the doll of the present invention is an effort to maintain and perpetuate the "inner child" utilization thereof without disadvantages heretofore expressed, particularly in a doll which is virtually devoid of moving parts, yet is simplistic in design and operation.

SUMMARY OF THE INVENTION

In keeping with the foregoing, a novel doll of the present invention includes a body having a chest portion which in turn includes an area capable of being illuminated. This area might be, for example, a translucent heart-shaped area, a celestial body, such as a quarter-moon or the like. An appropriate silhouette is provided, and this can simply be printed upon an interior surface of the translucent area or a sheet of opaque material can be adhesively adhered thereto. When the light or comparable illuminating means is not energized, the silhouette is not visible when the doll is viewed from the front, and all that is seen is the heart. However, upon the illumination of the interior of the doll, the light rays pass through the heart, but not through the silhouette and, therefore, from the exterior one viewing the doll sees the "bright" heart and the silhouette thereupon. The silhouette might be for example that of a small "inner child" or "soul" and the child or adult utilizing the doll would, for example, press a concealed switch or simply squeeze the doll which would activate a pressure-sensitive switch to illuminate the heart and create the silhouette. The switch might be instead motion-activated/non-motion deactivated so that a child by simply lifting the doll automatically lights the heart to create the silhouette, and so long as there is an appreciable amount of movement imparted to the doll, the light will remain lit. However, if the doll is not moved for a predetermined time period, for example three minutes, the light will extinguish to preserve the power of associated batteries. This is particularly desirable when the doll is given to a child incident to nap time or night bedtime which permits the child to "talk" to the silhouette of the "inner child" or "soul" when the doll is relatively sporadically mobile, yet when the child falls asleep, the light will subsequently self-extinguish.

Preferably the doll has human characteristics and, obviously, the "inner child" silhouette replicates the same. Hence, the child or adult utilizing the doll can rationalize the doll itself as having an inner child, namely, the silhouette thereof. Accordingly, the silhouette preferably corresponds in configuration to the characteristics of the doll. In other words, if the doll is a "female" doll, preferably the silhouette is that of a female, if the doll is a "male" doll, the silhouette is a male, etc.

In further accordance with this invention, arms of the doll can hold to the dolls chest an object which preferably is a relatively cuddly smaller bear, and in such case the silhouette replicates the doll and the bear, namely, a humanoid silhouette carrying a bear silhouette. In this case, the user of the doll has before him or her both the doll and the bear which is held by the doll, and upon illumination of the heart, the silhouette is that of a corresponding "humanoid" silhouette and a bear silhouette. Thus, a "warm" and understanding relationship is developed between the user of the doll and the doll itself, together with the "friend" (bear) of the doll and of the doll and bear silhouettes. In this fashion, a child who might have a sense of isolation or fears of loneliness will have in hand a doll as his companion, a bear as companion to both, and then all having as a companion their "friends" defined by the silhouettes of the doll and bear visible through the warm/illuminated heart.

In further keeping with the present invention, means are provided to simulate a heartbeat within the doll, such as a conventional electronic acoustical circuit or an actual miniature mechanical clock mechanism. Electronic acoustical heartbeat simulators can virtually run on a small battery for years on end, and preferably a conventional audio sound simulator of this type is utilized in association with the chest cavity of the doll so that the doll always possesses a "heartbeat." However, if for some reason it is desirable to utilize a simulated heartbeat on an indeterminate basis, a circuit can be, obviously, utilized to, for example, initiate the simulated heartbeat upon a switch being actuated, the doll being moved, pressure being applied to the doll, etc. However, by always having at least a faint "heartbeat," a child who takes the doll to bed will be subject to the desired monotony of the heartbeat which in turn causes sleep even should the doll become motionless and the light illuminating the heart extinguish. Thus, a child who initially takes the doll to bed has both light and sound as "emotional" friends and while "nodding-off," the sound of the heartbeat will remain even though the light might extinguish. Thus, a child taking the doll to bed is comforted continuously until he or she falls asleep.

The doll of the present invention also includes a head, hair, eyes, nose, face, arms, hands and feet, and preferably an exterior of the doll is fabricated from "loop" fabric fastener material, preferably the loop fabric fastener material is commonly termed VELCRO ® material. A portion of the loop fabric fastener material is applied to both hands of the doll, and thus one of the hands can be overlapped upon the remaining hand to essentially form a cradle into which the other object, such as the bear, can be placed and held. This is reminiscent of the position that a user would hold the doll itself, namely, against his or her chest cradled by the user's arms, and this represents both a psychological and a physiological connection between the user of the doll and the doll itself.

The "loop" fabric fastener material (VELCRO®) on the doll's hands enables the hands to be placed on the doll's face, limbs or body, and when thus temporarily fastened, they create a personality of expressions. For example, when a hand is "fastened" to the cover the eye or eyes of the doll, the doll appears to be playing the game of "peek-a-boo." When the doll's hand is fastened over the doll's mouth, the doll would appear to be saying "Oh-Oh!" Also, the hands can be fastened to other objects, such as the paws or hands of the bear or other animals, the latter animals also being totally covered with loop fabric fastener material (preferably female) with "male" fabric fastener sewn or applied to the bear's paws or hands. In this fashion the bear or similar objects can themselves be "fastened" anywhere on the doll. For example, the bear can be attached to the doll to provide the appearance of crawling up the dolls leg, giving a more life-like appearance of hugging or clinging.

The present invention also provides a novel doll including a body having a chest portion which includes an area capable of being illuminated, such as the aforementioned translucent heart-shaped area. However, in lieu of an appropriate silhouette which can be back-lit, the doll interior includes a mechanism upon which an object is rotated and back-lit by an appropriate lamp. As the object rotates its shadow cast upon the translucent heart-shaped area varies in shape and size depending upon the particular rotated position of the rotating object. In the preferred embodiment of the invention the object is a small doll carrying still a smaller doll in arms extended hand-in-hand gripping relationship. As the two dolls simultaneously rotate, the images thereof become progressively larger and smaller and vice versa, as well as shifting laterally and at times varying in size vertically depending, of course, not only upon the position of the two dolls relative to the translucent heart-shaped area or heart, but also the curvature of the heart relative thereto. Because of the object(s) rotation and curvature of the translucent heart area, the image of the two dolls upon the translucent heart can vary such that the images progressively enlarge and subsequently reduce in size and/or vice versa during the rotation thereof, again depending upon the particular location of the two dolls relative to the translucent heart area and the lamp. This continuous change in the size and shape of the image formed on the translucent heart area tends to have a strong psychological and emotional impact upon the user of the doll because it presents to the user a continuing, changing and growing life image susceptible to many different interpretations.

In its broader aspects, the present invention is not limited to a doll but instead, the concept of a rotating object(s) positioned between a translucent imaging surface and a source of illumination can be utilized in a variety of other environments and objects. For example, a "bunny" or a "rabbit" can form the rotatable object within a hollow "egg" having a transparent wall. Upon lighting an associated lamp, the silhouette of the bunny will appear upon the translucent wall of the egg. As another example of the utilization of the invention, a jewelry box could be provided with a heart upon an upper lid thereof housing within the heart a rotating object, such as a ballerina, a little girl, a doll or the like. One surface of the heart would be formed of translucent material and upon the illumination of a lamp within the heart and upon the rotation of the ballerina, the silhouette upon the translucent surface or wall of the heart would appear to be twirling or dancing, approaching and receding, etc. The invention can as well be utilized as an ornament atop a wedding cake, and in such a case the rotating object(s) would be a bride and groom. As part of a gift package, a heart could be placed above the package and a faceted light-reflected object would transmit a light from an internal lamp upon a translucent surface of the heart in a twinkling/blinking type display. Another example is the utilization of the invention as part of a book. These are but nonlimiting examples of the overall utility of the present invention.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is an enlarged fragmentary front elevational view of the heart area of the doll, and more clearly illustrates the shape of the heart and the silhouette of the "inner child" and bear viewable from the rear upon the illumination of the light/lamp.

FIG. 1, illustrates a hand of the doll carrying male loop fastening material which in FIG. 2 fastens to female loop fastening material from which the exterior surface of the doll torso is constructed.

DESCRIPTION OF THE PREFERRED EMBODIMENTS

Figure 1:
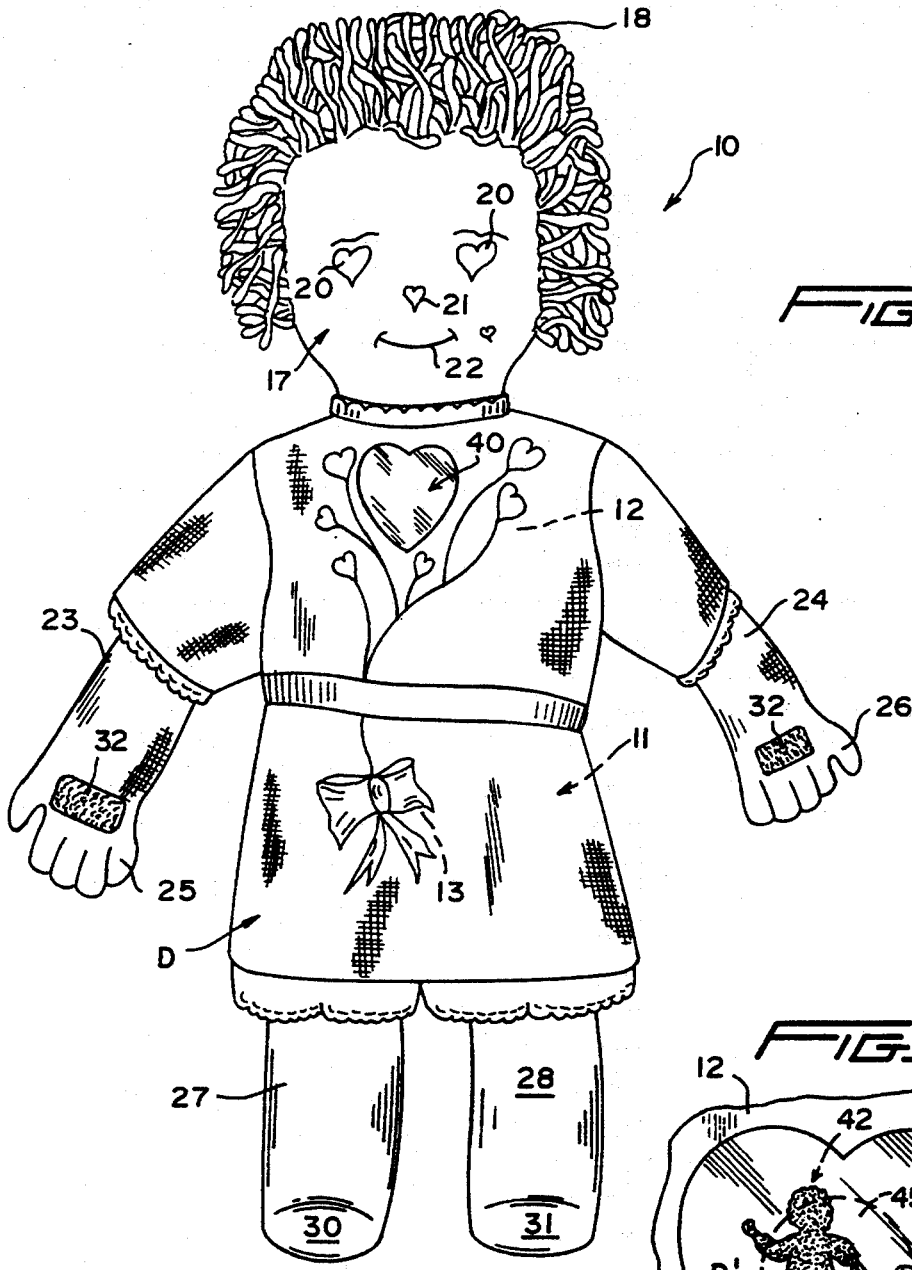
FIG. 1 is a schematic front elevational view of a novel doll of the present invention, and illustrates a torso thereof, including a chest portion delineating a heart area, a pair of arms, a pair of legs, a head and its associated hair, eyes, nose and mouth.
Figure 2:
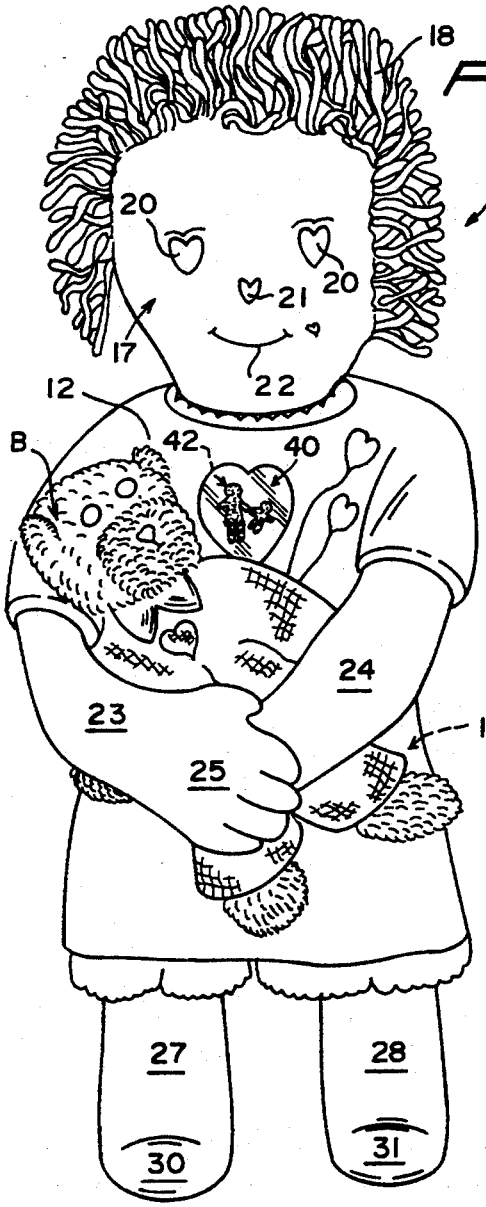
FIG. 2 is a front elevational view similar to FIG. 1, and illustrates the arms of the doll folded and embracing a bear, and the heart area is illuminated, as compared to FIG. 1, and now capable of being seen because of the illumination is the silhouette of an "inner child" holding the silhouette of a bear.
Figure 3:
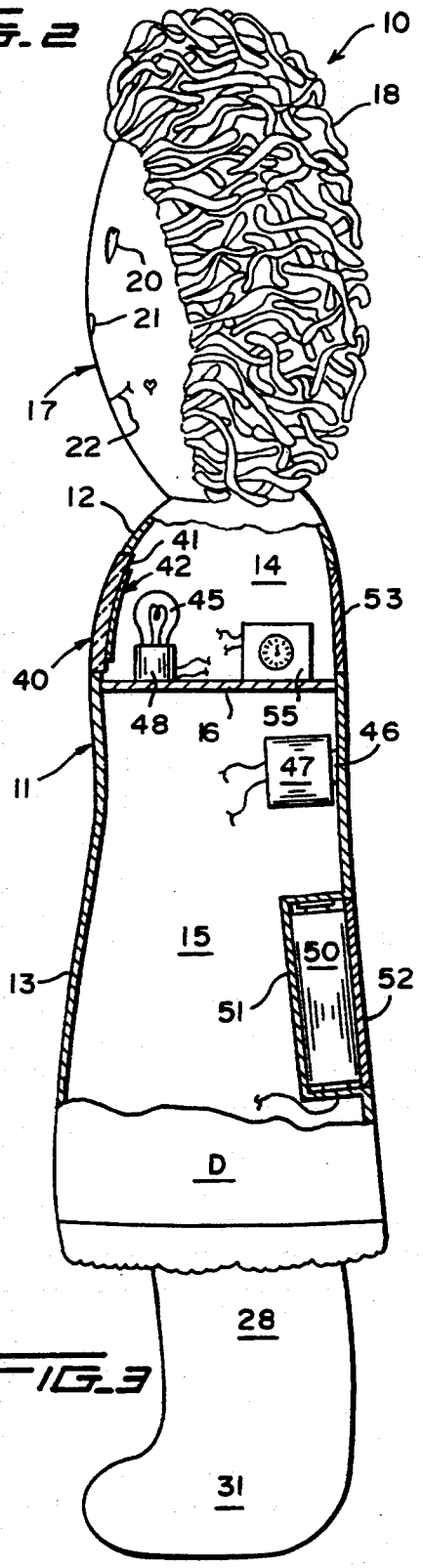
FIG. 3 is a vertical sectional view taken through the doll of FIG. 1, and illustrates the heart area, the silhouette applied to a rear surface thereof, a lamp, means for simulating a heartbeat, a battery and a pressure-sensitive and/or motion-activated switch for energizing the lamp and/or the heartbeat simulating means.

A novel doll constructed in accordance with this invention is fully illustrated in FIGS. 1 through 3 of the drawings and is generally designated by the reference numeral 10.

The doll 10 includes a torso 11 of a generally hollow construction having an upper front chest portion 12 and a lower torso portion 13 internally of which are a pair of cavities or chambers 14, 15 separated by a wall 16.

A head 17 carries hair 18 and appropriate eyes 20, a nose 21 and a mouth 22. Movable arms 23, 24 having hands 25, 26 are also carried by the torso 11, as are legs 27, 28 having respective feet 30, 31. An entire exterior surface of the head 17, torso 11, arms 23, 24, hands 25, 26, legs 27, 28 and feet 30, 31 are formed from conventional loop fastener material, such as VELCRO®. A piece of loop fastener material 32 (FIG. 5) is sewn or adhesively secured to an inside or palm surface (unnumbered) of each of the hands 25, 26. Thus, when an object, such as a bear B or similar soft "toy," is positioned across the upper torso chest portion 12, as shown in FIG. 2, the arms 23, 24 can be brought into cradling relationship thereto and the loop fastener material 32 contacts and grips the loop fastener material constituting the exterior surface of the arm 24, as shown in FIG. 2. Thus, just as a child or an adult would hold or cradle the doll 10, so too does the doll 10 hold or cradle the bear B or similar object.

The chest portion 12 includes means generally designated by the reference numeral 40 for delineating a predetermined portion within the upper torso chest portion 12. In this case the delineating means is a piece of translucent plastic material of a heart-shaped configuration which is preferably colored, with the colors red, yellow or gold, blue, orange, green or lavender being preferable. An inside or rear surface 41 of the translucent heart- shaped portion or heart 40 includes means 42 for creating a silhouette. The silhouette is viewable from the exterior of the doll 10 looking through the heart 40 when illuminating means 45 in the form of a miniature electric light bulb is illuminated by the user of the doll 10 by depressing a push-button 46 of a electrical switch 47 which is connected by suitable wires (unnumbered) to a socket 48 of the lamp 45 and a battery 50 housed in a recess 51 of the lower torso portion 13 which is closed by a door or flap 52 which provides access to the battery 50 for replacement purposes. A like door 53 provides access to the upper cavity or chamber 14 and, if desired, a similar door can be provided in the lower torso portion 13 for gaining access to the switch 47. Though the switch 47 is illustrated as a push-button switch, the same may be a pressure-sensitive switch of high sensitivity, such that the same will close and activate the lamp 45 when the torso 11 of the doll is simply hugged or cradled by the user. Alternatively, the switch 47 can be a conventional motion actuated switch operative to close the circuit and light the lamp 45 when the doll 10 is initially moved. Such motion activation switches will remain "ON" for a predetermined time period (time delay), and if the doll 10 is immobile thereafter, the lamp 45 will automatically extinguish. However, so long as the doll 10 is moved even intermittently by the user thereof, the lamp 45 will remain energized.

Within the upper cavity 14 is also means 55 for simulating a human heartbeat, such as an electronic clock which can either be part of the circuit which includes the battery 50, but preferably the simulating means 55 is at all times energized irrespective of the "OFF" or "ON" condition of the switch 47. The latter is desired because should the doll be taken to bed by a user, the lamp 45 might be initially lit allowing the silhouette 42 to be viewed from the exterior of the heart 40, while the heartbeat is created by the heartbeat simulating means 55. However, should the child begin to fall asleep and become basically motionless, the lamp 45 will extinguish if the switch 47 is of the motion-activated type, yet the "heartbeat" will continue.

Figure 4:
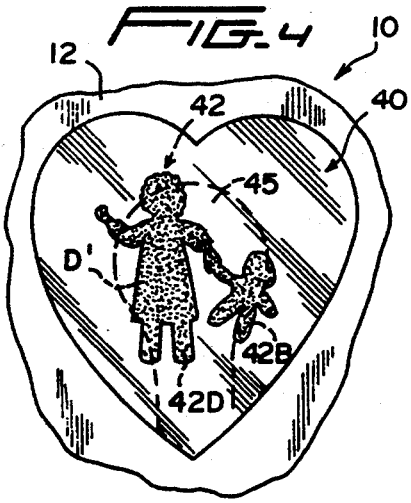
FIG. 4 which appears on the sheet of drawing containing

The means 42 for creating a silhouette viewable through the heart is more clearly illustrated in FIG. 4, and when viewed from the exterior with the lamp 45 lit, the contour or configuration thereof corresponds to the contour or configuration of the doll and the object being held. In other words, the doll 10 is a "female" doll and carries or embraces a bear B and the silhouette 42 includes silhouette portions 42B which is preferably of the shape and configuration of a bear and a silhouette portion 42D which is preferably of the shape and configuration of a "female" noting the same includes a dress D' corresponding to a dress D of the doll 10. The silhouette defining means 42 can be printed or painted upon the interior surface 41 of the heart 40 or can be a piece of opaque material adhesively applied to the surface 41. However, irrespective of the particular characteristic of the silhouette creating means 42, the same is not visible from the exterior of the heart 40 when the lamp 45 is de-energized/extinguished and becomes visible from the exterior only when the lamp or bulb 45 is energized/lit.

OPERATION

As compared to the relatively intricate utilization or operation heretofore described relative to the doll of Pat. Nos. 5,094,621 and 5,197,885, the doll 10 can be utilized by a child or adult in a very straightforward manner, even absent utilization of the bear B. However, if the bear B or another object is not to be utilized or cradled by the doll 10, the silhouette 42 is appropriately modified to exclude the silhouette portion 42B of the bear B. In other words, if the doll 10 is to be utilized alone, only the "female" silhouette portion 42D would be utilized, and the bear silhouette portion 42B would be excluded. However, if the bear B is utilized, the bear silhouette portion 42B is utilized. Additionally, if the doll 10 is a male doll, obviously, the silhouette portion 42D would be changed into the appearance of a male, and the doll 10 would be dressed correspondingly. However, in the context of the doll 10 and the bear B heretofore described, the child or adult user thereof utilizes the doll 10 as a self-help instrument to whom one can talk about ones day, likes, loves, wishes, hopes, dreams, as well as concerns about ones dislikes, problems, worries, apprehensions, etc. in the absence of outside personal/professional/parental assistance. For example, a child need but first talk to the doll of the child's problems and thereafter squeeze, hold or cuddle the doll 10 such that the switch 47 is closed to energize the lamp 45 which then makes visible the silhouette 42. The visibility of the silhouette 42 thereby becomes an acknowledgement by the doll 10 that the words, thoughts and emotions of the child have been conveyed and considered by the doll 10 and the visual silhouette is a positive reflection of the doll's interest, understanding, acknowledgement and help. As a specific example of the latter, many children are fearful of the dark and with or without the utilization of a "night light," a child could take the doll 10 and the bear B to bed and might verbally acknowledge to the doll 10 a fear of the dark, yet when the doll's torso 11 is hugged or squeezed, the light or lamp 45 will illuminate making the silhouette visible to the child and the latter is an acknowledgement by the doll 10 that the child need not be fearful because the "inner child" of the doll (silhouette 42) understands, empathizes and, obviously, protects the child "from the darkness." The simulated heartbeats from the heartbeat simulating means 55 also add to the comforting effect and further ensures the child that all is well and morning will come. Obviously, when the child falls asleep, the doll 10 will become motionless, the switch 47 will eventually open and the lamp 45 will extinguish, though preferably the heartbeats continue to emanate from the simulating means 55. A child or adult can be assured that he or she is not alone, has a friend in the "inner child," and the world is in fact "warm" and "safe." The child, adult or user of the doll may also see themselves as the doll and feel that he or she is talking or identifying with their own inner self.

Figure 6:
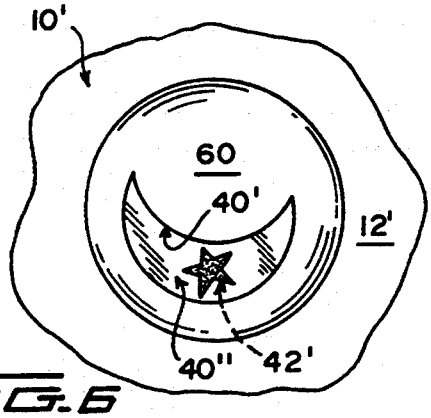
FIG. 6 is a fragmentary front elevational view of a portion of a torso of another doll, and illustrates a circular opaque area which has a moon-shaped slot through which can be viewed a piece of translucent plastic having printed or adhered to the rear surface thereof a star silhouette or the like viewable upon back lighting interiorly of the torso.

Another embodiment of the doll 10 is shown in FIG. 6 with like structure being identified by the same though primed reference numerals. In this case a doll 10' is provided which can be essentially identical to the doll 10 heretofore described except for the specific contour or configuration appearing at the upper torso chest portion 12'. In this case, a circle 60 of opaque material is provided with a cut-out 40' which defines the means for delineating a predetermined portion within the overall area of the chest portion 12'. In this case the delineating means is simply a cut-out formed in the material 60 of a celestial configuration, namely, a cut-out in the shape of a moon. The piece of material 60 overlies a translucent a piece of plastic 40'' of virtually any shape which is preferably colored as stated heretofore. The piece of plastic 40'' might, for example, be a perfect circle of generally the size of the piece of material 60. The cut-out 40' obviously lends the moon appearance to the piece of plastic 40''. Upon an interior surface (unnumbered) of the piece of plastic 40'' is the means 42' for creating a silhouette viewable through the piece of plastic 40'' when a light or lamp (not shown) corresponding to the light or lamp 45, is energized. In this case the silhouette creating means 42' is contoured in the shape of a star or similar celestial body, and, though not illustrated, this celestial motif is carried through the entire overall appearance of the doll 10'. For example, though not illustrated, the doll 10' might have star eyes instead of the heart eyes 20 of the doll 10 and instead of the six hearts (unnumbered) shown on the upper torso chest portion 12 of the doll's dress D and upon the chest of the bear, these hearts can be replaced by moons or stars or similar constellations, such as the rings of saturn which collectively project the concept of "heaven" or a "hereafter" and/or a "higher power." Adults in particular can more frequently relate to a higher power than perhaps to the concept of the "inner child," and there would be less hesitancy of an adult expressing his or her feelings concerning the "God of his/her understanding" to the doll 10'. Essentially the operation of the doll 10' is, therefore, the same as the doll 10 except, of course, the silhouettes are different as are the characteristics of each of the dolls, but each doll is specifically contoured, configured, dressed, etc. to carry forth a specific theme which is reflected absent illumination of the lamp 45, yet is emphasized and highlighted by the illumination thereof through the silhouette means 42 and 42'.

In lieu of the two-dimensional silhouette means 42 and 42', another three-dimensional silhouette means (not shown) can be provided, as, for example, a small three-dimensional statue of a "female" holding a three-dimensional "bear." Such a three-dimensional silhouette means can be enclosed in a "hollow" heart lit as heretofore described. The latter three-dimensional silhouette can at times provide a more realistically appearing "silhouette" than the painted/printed silhouette means 42, 42'.

Figure 7:
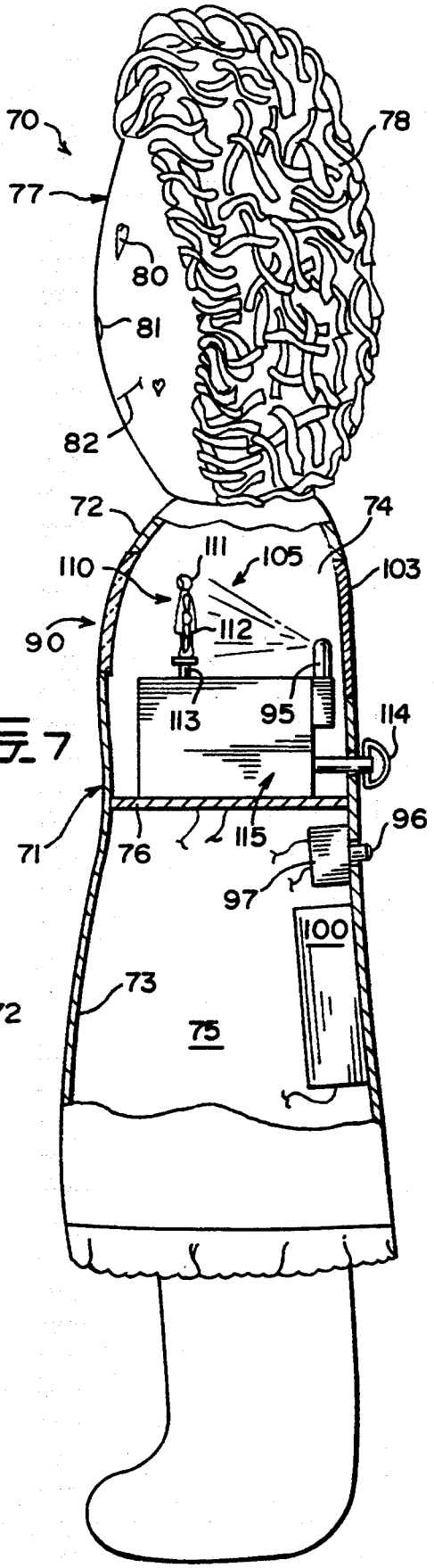
FIG. 7 is a vertical sectional view taken through another doll of the present invention and illustrates a heart area and a mechanism within the body of the doll for rotating an object which is back-lit by a lamp to produce a silhouette on the heart area.

Another novel doll constructed in accordance with this invention is illustrated in the FIGS. 7–15 of the drawings and is generally designated by the reference numeral 70 (FIG. 7).

The doll 70 includes a torso 71 of a generally hollow construction having an upper front chest portion 72 and a lower torso portion 73 internally of which are a pair of cavities or chambers 74, 75, respectively, separated by a wall 76.

A head 77 carries hair 78 and appropriate eyes 80, a nose 81 and a mouth 82. The doll 70 includes arms and legs (unnumbered) corresponding to the arms 23, 24 and legs 27, 28 of the doll 10. The doll 70 also includes hands corresponding to the hands 25, 26 of the doll 10, and associated therewith is also a bear, doll or similar humanoid figure, such as the bear B of FIG. 2. However, the doll 70 carries the bear B in arm extended hand-to-hand gripping relationship, much as shown in the silhouette depicted in FIG. 4, the purpose of which is significant and shall be described more fully hereinafter.

Figure 5:
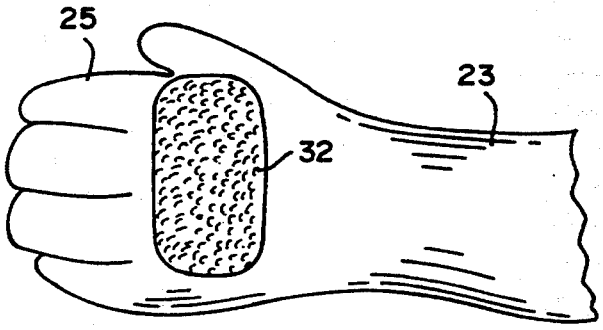
FIG. 5, which also appears on the sheet of drawing containing

The entire exterior surface of the head 77, torso 71 and the arms and legs are formed from conventional loop fastener material, such as VELCRO ®. A piece of loop fastener material (not shown), corresponding to the material 32 of FIG. 5, is also utilized in conjunction with the doll 70 and the bear associated therewith.

The chest portion 72 includes means generally designated by the reference numeral 90 (FIGS. 7-10, 2 and 14) for delineating a predetermined portion within the upper torso chest portion 72. In this case the delineating means 90 is a piece of translucent plastic material which is curved into planes and is of a heart-shaped configuration which is preferably colored, with the colors red, yellow or gold, blue, orange, green or lavender being preferable. The heart-shaped area, portion or heart 90 does not, however, include a silhouette such as the silhouette 42 of the doll 10, but does include illuminating means 95 in the form of a lamp or miniature bulb which can be appropriately lit by pressing an exposed push button 96 of an electrical switch 97 which is connected by suitable wires (unnumbered) to the lamp 95 and to a battery 100 housed in the lower cavity 75 of the lower torso portion 73 which is closed by an appropriate door (not shown) which provides access to the battery 100 for replacement purposes. A like door 103 provides access to the upper cavity or chamber 74.

Within the upper cavity 74 is also means 105 for creating a silhouette of varying size and shape viewable through the predetermined heart-shaped portion 90 upon the operation of the illuminating means or lamp 95. The varying silhouette creating means 105 includes an object or objects 110 positioned between the translucent heart-shaped area 90 and the illuminating means or lamp 95, as well as means 115 for moving, specifically rotating, the object or objects 110 relative to the translucent heart-shaped portion 90 and the lamp or illuminating means 95. In the preferred embodiment of the invention, the objects 110 include a small humanoid object 111 holding by one of its arms and associated hand (unnumbered) a still smaller humanoid object 112 with the two objects 111, 112 being in arms extended and hand-to-hand gripping relationship. The objects 110 are supported atop a rotatable post 113 of the rotary means 115 which is a conventional spring loaded/spring powered mechanism wound by an exteriorly exposed key 114. The mechanism 115 is conventionally utilized in music boxes or the like, and the specifics of the construction thereof form no part of the present invention. However, after the key 114 is wound and released the shaft 113 continuously rotates the objects 111, 112 which create silhouettes 111S, 112S, respectively, upon the heart-shaped translucent portion 90 when the latter is viewed from the exterior of the doll 70, as is best shown in FIGS. 8, 9 and 10.

Figure 8:
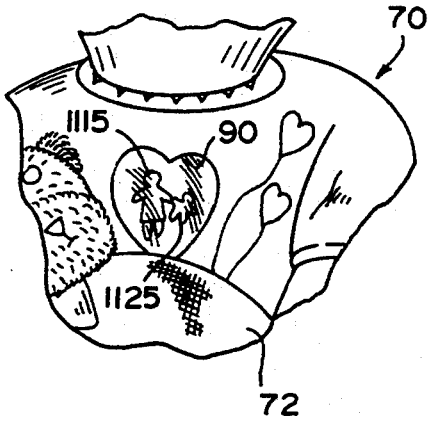
FIG. 8 is a fragmentary front elevational view of the heart area, and illustrates the silhouette formed thereon.
Figure 9:
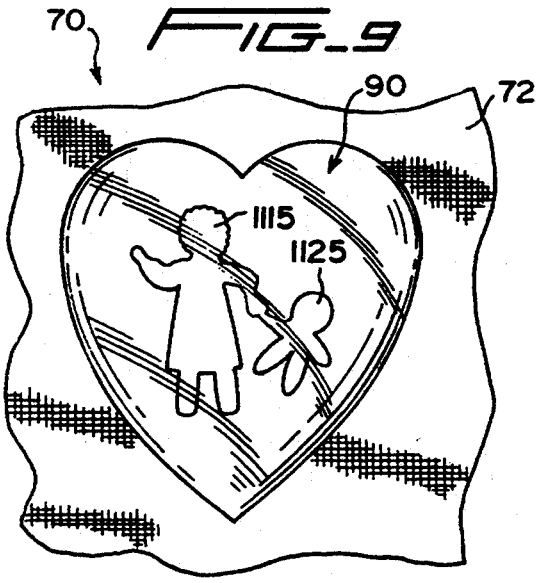
FIG. 9 is an enlarged front elevational view of the heart area of FIG. 8 and illustrates the silhouette in the form of a large doll carrying hand-in-hand a smaller doll with the size and shape of the doll silhouette corresponding to the position of the two dolls in FIG. 7, namely, both facing the heart-shaped area.
Figure 11:
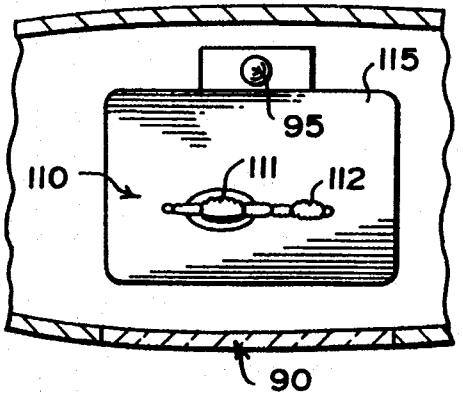
FIGS. 10 and 11 are fragmentary front elevational and cross sectional views, respectively, of the heart area and the interior of the doll and illustrate the silhouette as it appears upon the heart-shaped area in relationship to the position of the two dolls.
Figure 13:
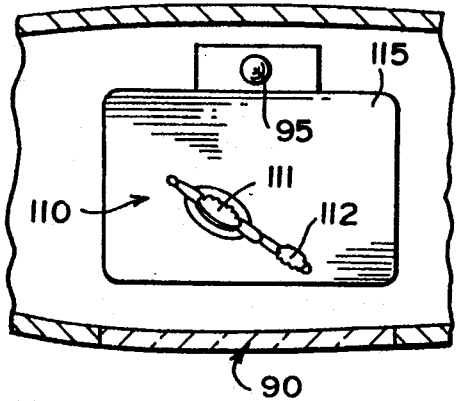
FIGS. 12 and 13, and 14 and 15 are Figures similar to FIGS. 10 and 11, respectively, but illustrate the hand-in-hand dolls rotated to two different positions and the manner in which these two different positions alter the size and/or shape of the silhouette formed upon the heart-shaped area.
Figure 15:
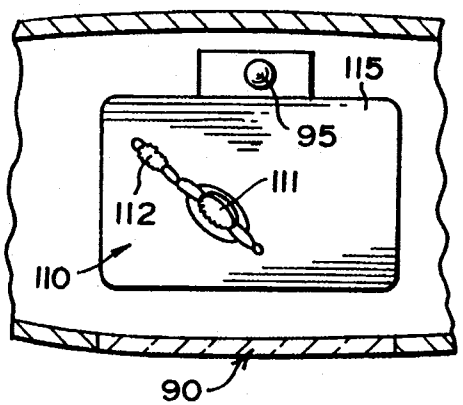
Figure 10:
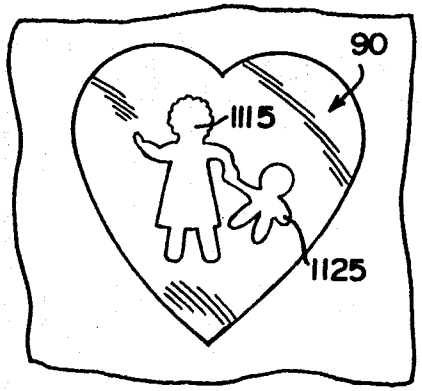
Figure 12:
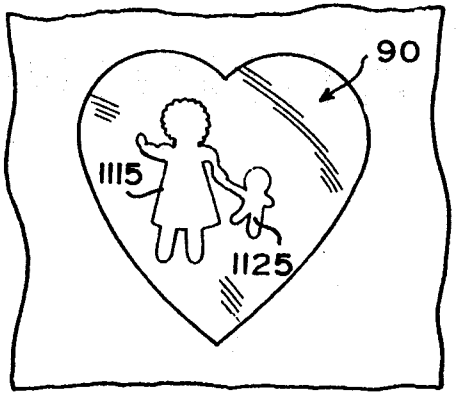
Figure 14:
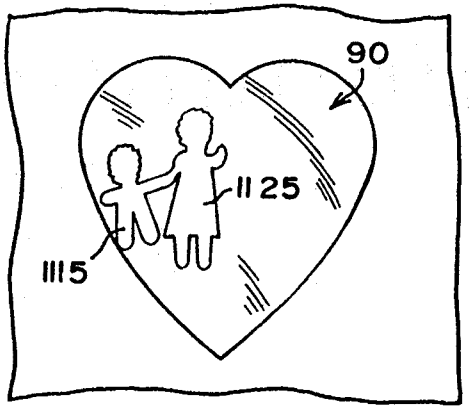

Referring specifically to FIGS. 8, 9 and 10, the silhouettes 111S and 112S reflect the position of the objects 111, 112 shown in FIGS. 7 and 11, namely, the objects in forward facing position "looking," so to speak, straight at the heart-shaped portion 90. In this forward facing position both objects 111, 112 are essentially equally spaced from the lamp 95 and the heart-shaped portion 90, and thus the silhouettes 111S, 112S will appear as shown in FIGS. 9 and 10. However, as the shaft 113 rotates clockwise, as viewed from above, the object 112 will rotate toward the translucent heart-shaped portion 90 and thus the distance will progressively decrease toward the same while increasing from the lamp 95, as shown in FIG. 13. This causes the silhouette 112S of the object 112 appearing on the heart-shaped portion 90 to decrease in size and alter in shape due to the curvature of the heart-shaped portion 90, from the position shown in FIGS. 9 and 10 toward an intermediate position, such as the position shown in FIG. 12. Therefore, in FIGS. 8 through 11, the silhouettes 111S and 112S accurately represent the actual configuration of the objects 111, 112, respectively, but during rotation of the objects 111, 112 the size and shape of the silhouettes 111S and 112S will continuously change in size and shape, as shown in FIG. 12.

At a point at which the object 111 is between the object 112 and the lamp 95 (not shown), the silhouette 112S will not be visible upon the heart-shaped portion 90 and only the silhouette 111s will be present thereon. This position occurs when the object 112 is as close to the heart-shaped portion 90 as is possible, and when the object 112 is as close as possible to the lamp 95. In both of the latter positions only the silhouette 111s will appear on the heart-shaped portion 90.

During rotation the silhouette 111s of the object 111 is displaced slightly relative to the axis of rotation, as defined by the shaft 113 because the axis of rotation generally passes vertically through the object 111. The object 112 will change more significantly in size because it is radially outboard of the axis of rotation and thus will more significantly both increase and decrease in size depending upon its relationship distance-wise between the lamp 95 and the heart-shaped portion 90. For example, in FIG. 15 the object 112 has rotated closer to the lamp 95 than in FIG. 11 and thus the image of the silhouette 112S is larger in FIG. 14 than in FIG. 10. Since the image is larger some of the characteristics are clearer. Since the object 111 does, however, rotate and it is of greater width as measured from left-to-right in FIG. 11 than in girth as measured up and down in FIG. 11, the silhouette ills will also change somewhat, though not as dramatically as the silhouette 112S. This is also depicted relatively as shown in a comparison of FIGS. 10 and 14 in which the silhouette 111s is respectively wider and shorter in FIG. 10 as compared to taller and narrower in FIG. 14. Of course, since the heart-shaped portion 90 is itself of a multiple curved configuration, much as in the case of an anatomical human heart, the curvature thereof also changes the shape of the overall silhouette 111S/112S as the same are formed during the rotation of the object 110. Thus the rotation of the object 110 together with the multiple curvature of the heart-shaped portion 90 imparts a continuing varying silhouette configuration upon the heart-shaped portion 90, as is graphically depicted in FIGS. 8, 9, 10, 12 and 14 of the drawings.

Figure 16:
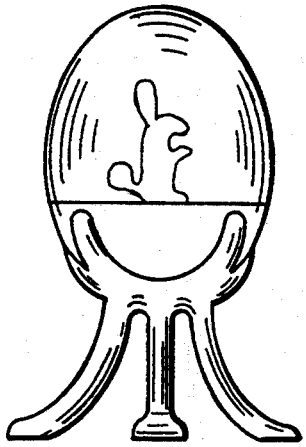
FIGS. 16 and 17 are front elevational and cross-sectional views, respectively, of a plastic egg having a translucent wall and a hollow interior within which is housed a rotating rabbit or bunny and an associated lamp.
Figure 17:
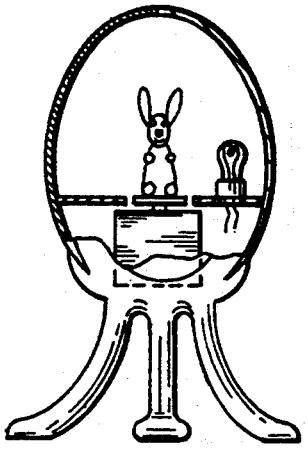

In further keeping with the present invention, reference is made to FIGS. 16 and 17 which illustrate the invention in a different environment or application than that of an associated doll. More specifically, the invention of FIGS. 16 and 17 includes a device 200 in the form of a generally egg-shaped hollow body having an upper body portion 201 and a lower body portion 202 supported by a stand 203. The lower body portion 202 is completely opaque and internally thereof houses a wind-up mechanism 204 having a shaft 205 supporting a bunny, rabbit or similar object 206. A circumferential line of demarcation 207 defines the boundary between the upper body portion 201 and the lower opaque body portion 202. The upper body portion 201 includes a chamber 208 above an interior wall 210 which supports a miniature lamp or light 211 energized by a suitable battery (not shown). The upper portion 201 includes a rear half wall 212 which is opaque and a front half wall 213 which is formed of translucent plastic material. Thus, when the lamp 211 is lit and the bunny/rabbit/object 206 rotates, a silhouette will be formed upon the wall 213 viewable from the exterior, as depicted in FIG. 16 with the silhouette being generally designated by the reference numeral 206S. Obviously, as the mechanism 204 rotates the rabbit/bunny/object 206, the silhouette 206S (FIG. 16) will vary in shape, size, etc.

Figure 18:
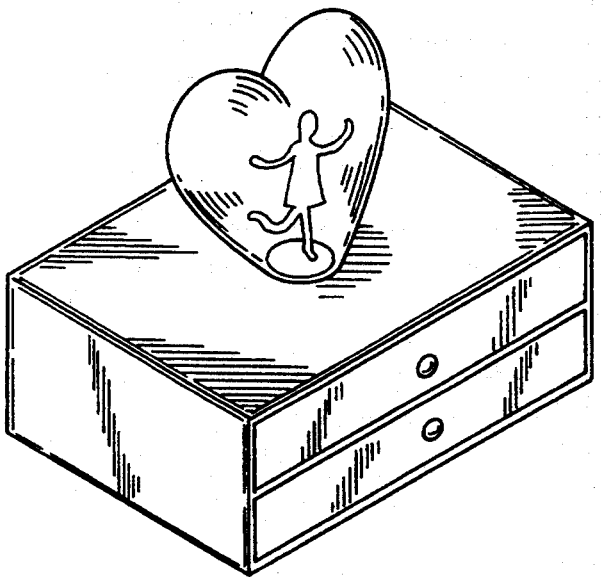
FIGS. 18 and 19 are perspective and fragmentary side elevational views, respectively, of a jewelry box upon which is mounted a hollow heart having a translucent wall and housing therein a rotating ballerina or doll and an associated lamp.
Figure 19:
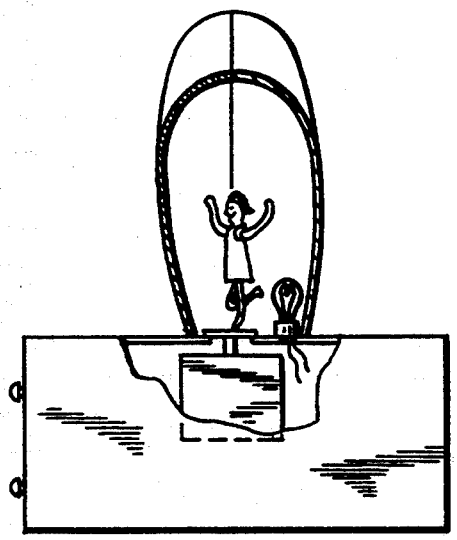

In FIGS. 18 and 19, the invention is disclosed in association with a jewelry box 220 having an upper wall 221 and jewelry drawers 222, 223, etc. The upper wall 221 includes an opening (unnumbered) through which projects a pedestal (unnumbered) of a shaft 224 of a mechanism 225 for imparting rotation to an object 226, such as a "ballerina" or similar doll. The object 226 and an associated light or lamp 227 are located within a hollow body 230 of a heart-shaped configuration split vertically along a plane 231 defining an opaque wall portion 232 and a translucent wall portion 233. As the ballerina 226 rotates, the light from the lamp 227 forms a silhouette 226S (FIG. 18) upon the wall 233 with the attendant rotation of the ballerina 226 imparting to the silhouette 226S a lifelike "twirling" motion accompanied by changes in size and shape, vertically and horizontally, as well as apparent motion toward and away from the wall 233.

Figure 20:
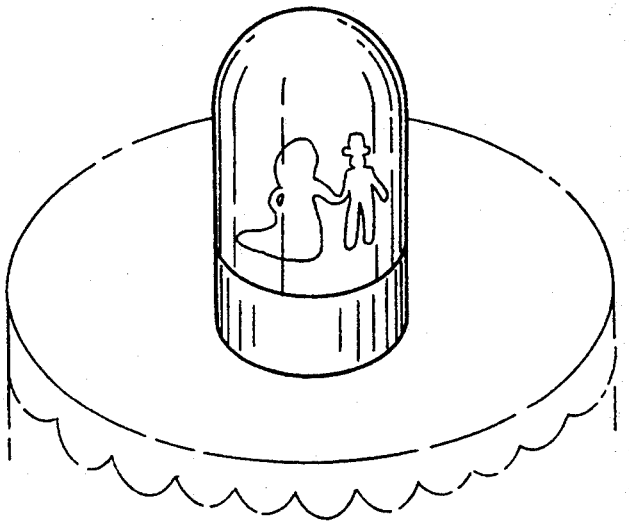
FIGS. 20 and 21 are perspective and cross-sectional views, respectively, of a wedding cake "ornament" having a hollow interior, a translucent wall, a rotating "bride and groom" figure and an associated lamp.
Figure 21:
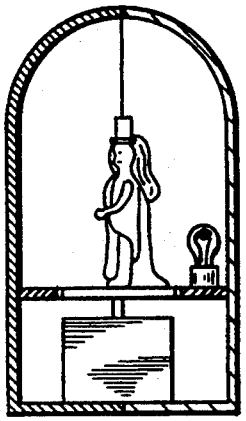

Another device 240 constructed in accordance with this invention is illustrated in FIGS. 20 and 21 and includes a housing having a lower opaque portion 241 and an upper portion formed by an opaque wall 242 and a translucent wall 243. Housed within the lower portion 241 is a conventional rotating mechanism 244 whose shaft 245 supports an object(s) in the form of a bride and groom 246 which casts a silhouette 246S (FIG. 20) upon the translucent wall 243 when a lamp or light 247 is lit. As the object 246 rotates, the silhouette 246S rotates and moves toward and away from the wall 243 imparting a "dancing" impression to the viewer.

Figure 23:
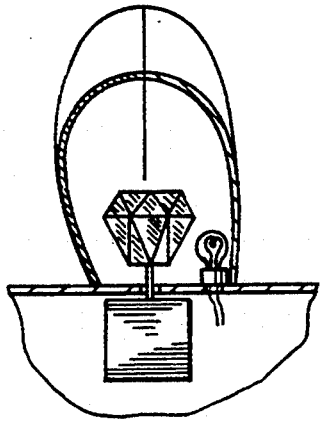
FIGS. 22 and 23 are perspective and fragmentary cross-sectional views, respectively, of a gift package mounting a heart thereupon in which is rotated a prismatic transparent object and a lamp which upon respective rotation and illumination casts varying spots and bands of light upon a translucent surface of the heart.
Figure 22:
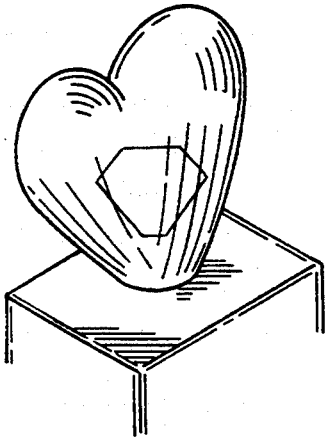

A device 250 of FIGS. 22 and 23 includes a conventional gift box 251 in which might be housed a diamond engagement ring, for example, a watch, or virtually any other gift one might give to a loved one. Secured atop the box or package 251 is a hollow body 252 of a heart-like configuration defined by a rear opaque wall 253 and a transparent front wall 254. A conventional mechanism 255 imparts rotation to a post or shaft 256 upon which is mounted a faceted transparent piece of glass 257 or a similar material which transmits, reflects and refracts light from a lamp 258 upon the wall 254. Due to the latter, the object 257 appears as a silhouette 257S (FIG. 22) upon the wall 254, but in addition the light rays passing through the object 257, as indicated by headed arrows 259 in FIG. 3, form moving "spots" of light generally designated by the reference numeral 259S in FIG. 22. Thus, the silhouette 257S not only changes size and shape and rotates, as viewed upon the wall 254, but spots or streaks of light 259S are also formed upon the wall 254 upon the rotation of the object 257 due to the movement of the light beams 259 upon the wall 254.

Figure 24:
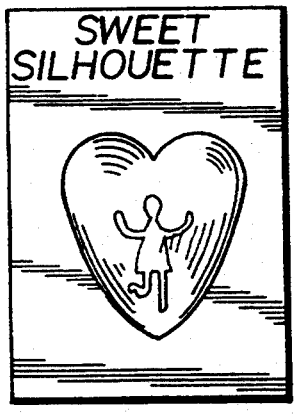
FIGS. 24 and 25 are front elevational and perspective views, respectively, of a book incorporating the present invention.
Figure 25:
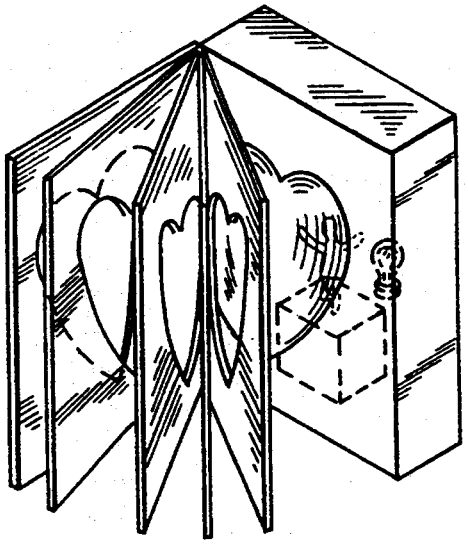

Another novel device constructed in accordance with this invention is illustrated in FIGS. 24 and 25 of the drawings and is generally designated by the reference numeral 260. The device 260 is a book having a front cover 261 provided with a heart-shaped slot or cut-out 262 which complements identical heart-shaped slots 263 formed in successive pages 264. A back cover 265 of the book 260 is hollow and includes therein structure identical to the elements 224 through 227 of FIG. 19 which have been identically numbered and primed in FIG. 25. In addition, a front wall 266 of the back cover is opaque and carries a translucent heart-shaped wall 267 upon which a silhouette 267S is formed (FIG. 24) when the lamp 227' is lit. Accordingly, when all of the pages 264 and the covers 261, 265 are closed, the translucent wall 267 is visible from the front (FIG. 24) and the silhouette 267S can be viewed both when the book 260 is 37 closed" or during the reading thereof, as is apparent in FIG. 25. During the latter, the lamp 267 obviously casts the shadow or silhouette 267S upon the wall 267 in the manner heretofore described relative to FIGS. 18 and 19.

Although a preferred embodiment of the invention has been specifically illustrated and described herein, it is to be understood that minor variations may be made in the apparatus without departing from the spirit and scope of the invention, as defined the appended claims.

I claim:

1. A doll comprising a body, said body including a chest portion, means for delineating a predetermined portion within said chest portion, means for illuminating said predetermined portion, and means for creating a silhouette of varying size and shape viewable through said predetermined portion upon the operation of said illuminating means.

2. The doll as defined in claim 1 wherein said doll includes specific characteristics imparting a particular contour thereto, and the varying silhouette created by said varying silhouette creating means corresponds generally to said doll particular contour.

3. The doll as defined in claim 1 wherein said predetermined portion is heart-shaped.

4. The doll as defined in claim 1 wherein said predetermined portion is translucent.

5. The doll as defined in claim 1 wherein said predetermined portion is heart-shaped and translucent.

6. The doll as defined in claim 1 wherein said doll is of a generally humanoid appearance and said varying silhouette is of a humanoid appearance.

7. The doll as defined in claim 1 wherein said doll is of a generally humanoid appearance, said doll carries a bear, and said varying silhouette includes both a humanoid appearance and a bear appearance.

8. The doll as defined in claim 1 wherein said doll is of a generally humanoid appearance and includes a pair of arms and hands, a bear, said bear including a pair of arms and hands, said doll holds said bear in arms extended hand-to-hand gripping relationship, and said varying silhouette includes both a humanoid appearance and a bear appearance in arms extended hand-to-hand gripping relationship.

9. The doll as defined in claim 1 wherein said predetermined portion is of a curved configuration.

10. The doll as defined in claim 1 wherein said predetermined portion is a translucent heart of a curved configuration.

11. The doll as defined in claim 1 wherein said varying silhouette creating means includes an object positioned between said predetermined portion and said illuminating means, and means for moving said object relative to said predetermined portion and said illuminating means.

12. The doll as defined in claim 11 wherein said object is a small humanoid whereby said varying silhouette is a varying humanoid silhouette.

13. The doll as defined in claim 11 wherein said object is a pair of small humanoids in arm extended hand-in-hand relationship whereby said varying silhouette is a pair of varying humanoid silhouettes in arm extended hand-in-hand relationship.

14. The doll as defined in claim 11 wherein said predetermined portion is heart-shaped.

15. The doll as defined in claim 11 wherein said predetermined portion is translucent.

16. The doll as defined in claim 11 wherein said predetermined portion is heart-shaped and translucent.

17. The doll as defined in claim 11 wherein said predetermined portion is of a curved configuration.

18. The doll as defined in claim 11 wherein said predetermined portion is a translucent heart of a curved configuration.

19. The doll as defined in claim 12 wherein said predetermined portion is heart-shaped.

20. The doll as defined in claim 12 wherein said predetermined portion is translucent.

21. The doll as defined in claim 12 wherein said predetermined portion is heart-shaped and translucent.

22. The doll as defined in claim 12 wherein said predetermined portion is of a curved configuration.

23. The doll as defined in claim 12 wherein said predetermined portion is a translucent heart of a curved configuration.

24. The doll as defined in claim 12 wherein said predetermined portion is heart-shaped.

25. The doll as defined in claim 12 wherein said predetermined portion is translucent.

26. The doll as defined in claim 12 wherein said predetermined portion is heart-shaped and translucent.

27. The doll as defined in claim 12 wherein said predetermined portion is of a curved configuration.

28. The doll as defined in claim 12 wherein said predetermined portion is a translucent heart of a curved configuration.

29. The doll as defined in claim 13 wherein said predetermined portion is heart-shaped.

30. The doll as defined in claim 13 wherein said predetermined portion is translucent.

31. The doll as defined in claim 13 wherein said predetermined portion is heart-shaped and translucent.

32. The doll as defined in claim 13 wherein said predetermined portion is of a curved configuration.

33. The doll as defined in claim 13 wherein said predetermined portion is a translucent heart of a curved configuration.

* * * * *